US007311424B1

(12) United States Patent
McCarthy

(10) Patent No.: US 7,311,424 B1
(45) Date of Patent: Dec. 25, 2007

(54) COMBINED ADJUSTABLE WORK LIGHT AND MULTI-POWER CORD ASSEMBLY

(76) Inventor: Kenneth McCarthy, R.R. #4 Box 60 Glen Dale Drive, Mechanicsburg, PA (US) 17050

( * ) Notice: Subject to any disclaimer, the term of this patent is extended or adjusted under 35 U.S.C. 154(b) by 41 days.

(21) Appl. No.: 11/404,259

(22) Filed: Apr. 14, 2006

Related U.S. Application Data

(60) Provisional application No. 60/671,040, filed on Apr. 14, 2005.

(51) Int. Cl.
*F21V 21/00* (2006.01)

(52) U.S. Cl. ..... 362/376; 362/109; 362/396; 320/111

(58) Field of Classification Search ..... 362/109, 362/376, 396; 320/114, 115, 135
See application file for complete search history.

(56) References Cited

U.S. PATENT DOCUMENTS 3,584,213 A 6/1971 Meltzer
5,833,357 A 11/1998 Ting
6,502,949 B1 * 1/2003 Horiyama et al. ..... 362/119
6,722,774 B2 * 4/2004 Kovacik et al. ..... 362/396
7,121,698 B1 * 10/2006 Johnson ..... 362/396

* cited by examiner

*Primary Examiner*—John Anthony Ward

(57) ABSTRACT

A combined work light and dual power cord device includes a light-emitting assembly including a protective cage with an access door. A handle is rotatably conjoined to the light-emitting assembly that has a corrugated outer surface. An axial bore is formed along an entire length thereof. A first hook is connected to a top end of the light-emitting assembly. A second hook is connected to a handle bottom end. Mechanisms are included for rotating the handle about a bottom end of the light-emitting assembly and rotating the second hook about the handle bottom end. Primary and secondary power cords are coupled to the handle. A mechanism is included for automatically and simultaneously distributing first and second currents to the primary and secondary power cords respectively so that the second current is only transmitted to the secondary power cord if the first current is passing through the primary power cord.

15 Claims, 4 Drawing Sheets

COMBINED ADJUSTABLE WORK LIGHT AND MULTI-POWER CORD ASSEMBLY

CROSS REFERENCE TO RELATED APPLICATIONS

This application claims the benefit of U.S. Provisional Application No. 60/671,040, filed Apr. 14, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to work lights and power cord assemblies and, more particularly, to a combined adjustable work light and multi-power cord assembly for providing users with a convenient power source for a peripheral electric powered device.

2. Prior Art

Over the years, many different types of tools have been developed and, nowadays, a tool exists for virtually every possible need. With the advent of power tools, accomplishing many tasks has become much easier and less time consuming. Most power tools (other than battery operated tools) are equipped with a fairly short power cable and extension cords are commonly used to provide extra length. Extension cords are a very convenient means of providing electrical power at locations removed from conventional electrical outlets and are used for a wide variety of applications and tasks.

Another device that is commonly used when performing work with powered or non-powered tools is a utility light, frequently referred to as a work light. A utility light is generally comprised of a light bulb, enclosed within a protective metal cage, and a fairly long power cord that supplies power to the bulb. A hook is usually attached to the metal cage for conveniently suspending the light bulb over the work area to provide sufficient light.

Utility lights with built in power outlets are known in the prior art, in which a power tool plug may be inserted. One prior art example shows a portable utility light that includes a socket assembly, a hollow handle for housing the socket assembly, and a wire mesh cage for protecting the light bulb. Unfortunately, maneuvering the light or the tool frequently causes the power tool plug to become dislodged, thus inconveniently interrupting the work process and causing a fair amount of frustration. Furthermore, the power cord provided with most tools is still too short to be comfortably used while being engaged with the utility light power socket.

Accordingly, a need remains for a combined adjustable work light and multi-power cord assembly in order to overcome the above-noted shortcomings. The present invention satisfies such a need by providing a work light and power cord assembly that is convenient and easy to use, is versatile in use, saves the user a considerable amount of time, and reduces the frustration associated with conventional work light power cord assemblies. Such a work light includes a pivoting handle that advantageously allows the light bulb to remain at a fixed position as the handle is being moved about when a user tugs on the power cord connected to the handle. The extended power cord conveniently allows a variety of peripheral electric devices to be attached to the work light, giving a user increased visibility of their work sight, while not interfering with the work process.

BRIEF SUMMARY OF THE INVENTION

In view of the foregoing background, it is therefore an object of the present invention to provide a combined adjustable work light and multi-power cord assembly. These and other objects, features, and advantages of the invention are provided by a combined work light and dual power cord device that includes a light-emitting assembly including a protective cage, which has an access door pivotally adaptable between open and closed positions.

An elongated handle is rotatably conjoined directly to the light emitting assembly. Such a handle has a corrugated outer surface for conveniently providing an increased gripping surface area. The handle has an axial bore formed therein. Such an axial bore extends along an entire longitudinal length of the handle. The handle is permanently attached to the light-emitting assembly.

A first hook is directly connected to a top end of the light-emitting assembly and is spaced from the handle. A second hook is directly connected to a bottom end of the handle and is spaced from the light-emitting assembly. A mechanism is included for freely rotating the second hook about the bottom end of the handle. Such a second hook rotating mechanism preferably includes a first semi-spherical hollow ball-bearing that is disposed at the bottom end of the handle and is rotatably seated within the axial bore. A first flat washer is nested within the axial bore and is directly anchored on the bottom end of the handle. Such a first washer has a flat top surface supporting the first ball-bearing thereon.

A mechanism is included for freely rotating the handle about a bottom end of the light-emitting assembly. Such a handle rotating mechanism may include a second semi-spherical hollow ball-bearing disposed at a top end of the handle and rotatably seated within the axial bore. The second ball-bearing is oppositely situated from the first ball-bearing and further remains statically registered within the axial bore when the first ball-bearing is freely rotated within the axial bore. A quick-release pin is directly anchored to the top end of the handle. Such a pin passes through the second ball-bearing and has opposed outer ends protruding to an exterior of the handle. The handle effectively maintains a static relationship with the second ball-bearing when the pin is passed through the handle.

Primary and secondary power cords are coupled to the handle. Such a secondary power cord may include a transparent cap that is directly mated to a distal end thereof. At least one LED is housed within the cap and is electrically coupled to the second switch. Such an LED illuminates when the second current is passing through the secondary power cord for advantageously and effectively notifying a user that the second power cord is hot.

A mechanism is included for automatically and simultaneously distributing first and second currents to the primary and secondary power cords respectively during operating conditions such that the second current is effectively transmitted to the secondary power cord if and only if the first current is passing through the primary power cord. Such an automatic and simultaneous current distributing mechanism preferably includes a first switch that is electrically coupled to an exterior power supply source. A current sensor is electrically coupled to the first switch and located downstream thereof. Such a current sensor is electrically coupled directly to the primary power cord. A second switch is electrically coupled directly to the current sensor and is located downstream thereof. Such a second switch is electrically coupled to the secondary power cord.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
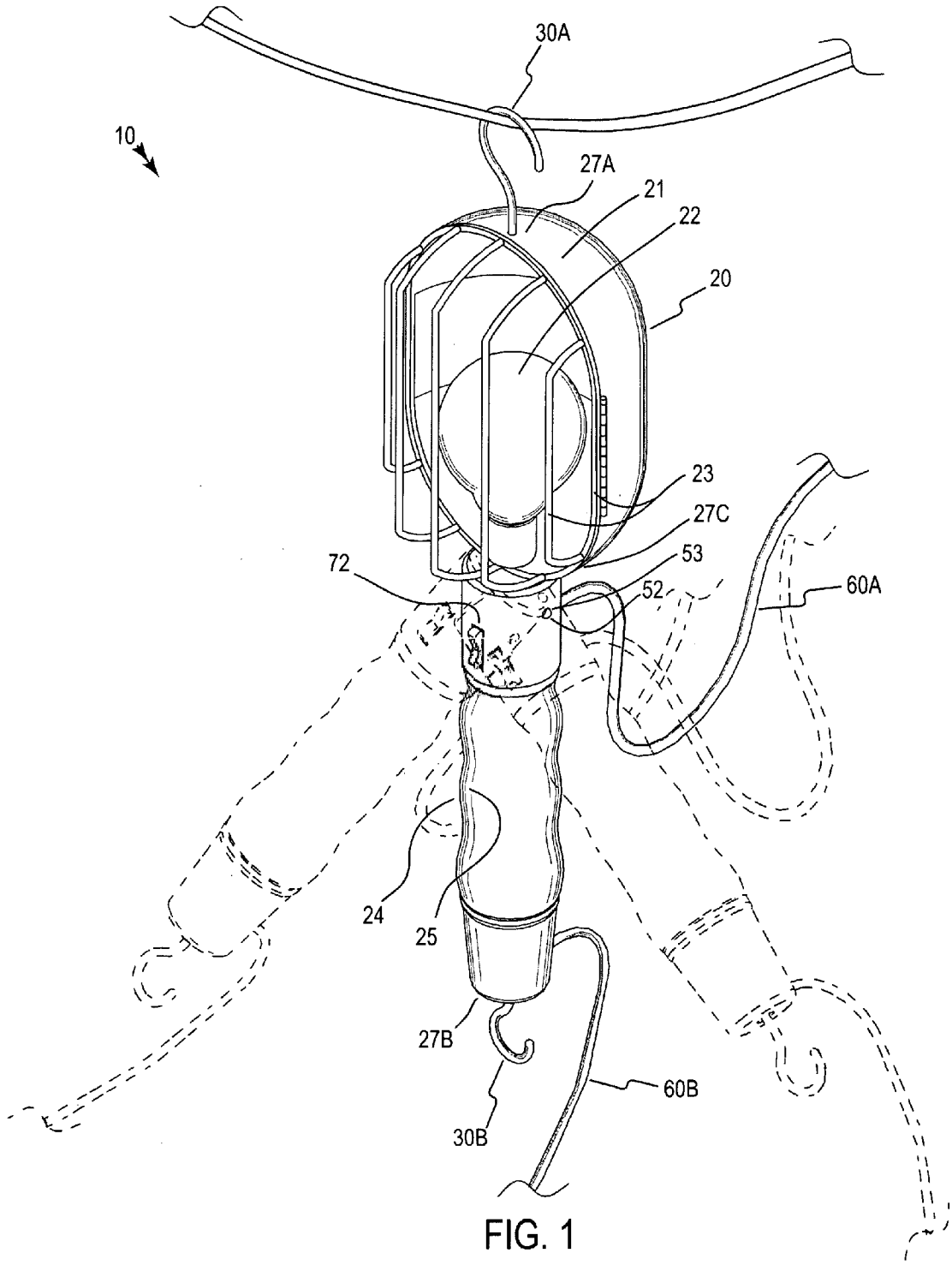
FIG. 1 is a perspective view showing a combined adjustable work light and multi-power cord assembly, in accordance with the present invention.
Figure 2:
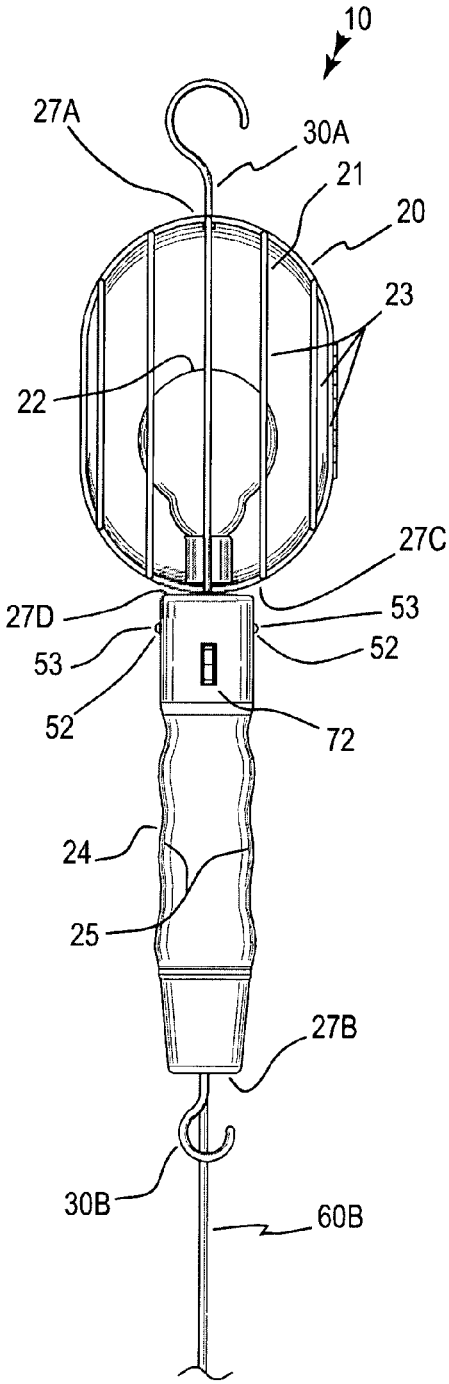
FIG. 2 is front-elevational view of the device shown in FIG. 1.
Figure 3:
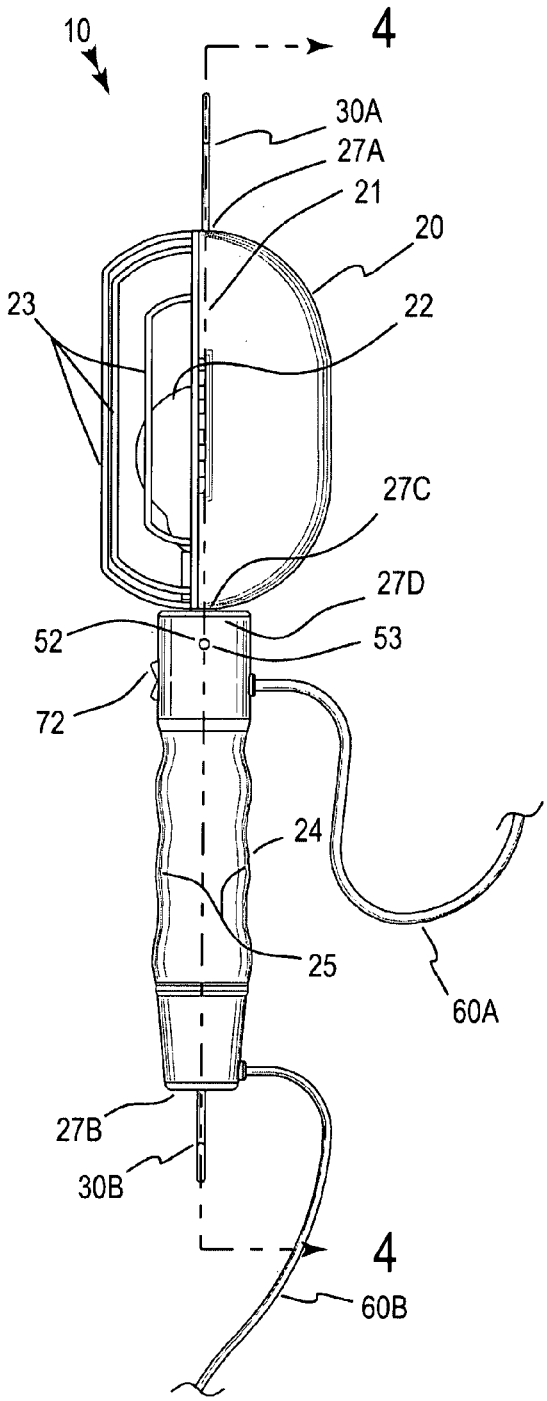
FIG. 3 is a side-elevational view of the device shown in FIG. 2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-6 by the reference numeral 10 and is intended to provide a combined adjustable work light and multi-power cord assembly. It should be understood that the device 10 may be used to provide light and a convenient power cord for many different types of tasks and applications, and should not be limited in use to only automotive mechanics.

Referring initially to FIGS. 1, 2, 3, 4 and 5, the device 10 includes a light-emitting assembly 20 including a protective cage 21, a light emitting source 22, which has an access door 23 pivotally adaptable between open and closed positions. Such a pivotal access door 23 is essential for allowing a user to periodically replace the light emitting source 22 located there within. Of course, the device 10 may be produced for employing a variety of alternate light emitting sources 22, depending on the user's lighting needs, as is obvious to a person of ordinary skill in the art. An elongated handle 24 is rotatably conjoined directly, without the use of intervening elements, to the light emitting assembly 20. Such a handle 24 has a corrugated outer surface 25 that is vital for conveniently providing an increased gripping surface area. The handle 24 has an axial bore 26 formed therein. Such an axial bore 26 extends along an entire longitudinal length of the handle 24. The handle 24 is permanently attached to the light-emitting assembly 20.

Referring to FIGS. 1, 2, 3 and 4, a first hook 30A is directly connected, without the use of intervening elements, to a top end 27A of the light-emitting assembly 20 and is spaced from the handle 24. A second hook 30B is directly connected, without the use of intervening elements, to a bottom end 27B of the handle 24 and is spaced from the light-emitting assembly 20. The presence of two hooks 30 is important for allowing the device 10 to be suspended in a variety of orientations such that a user may advantageously obtain the optimum amount of lighting for their specific task or application. Of course, the device 10 may include further or alternately located hooks 30, on a rear surface of the light emitting assembly 20 for example, as is obvious to a person of ordinary skill in the art.

Figure 4:
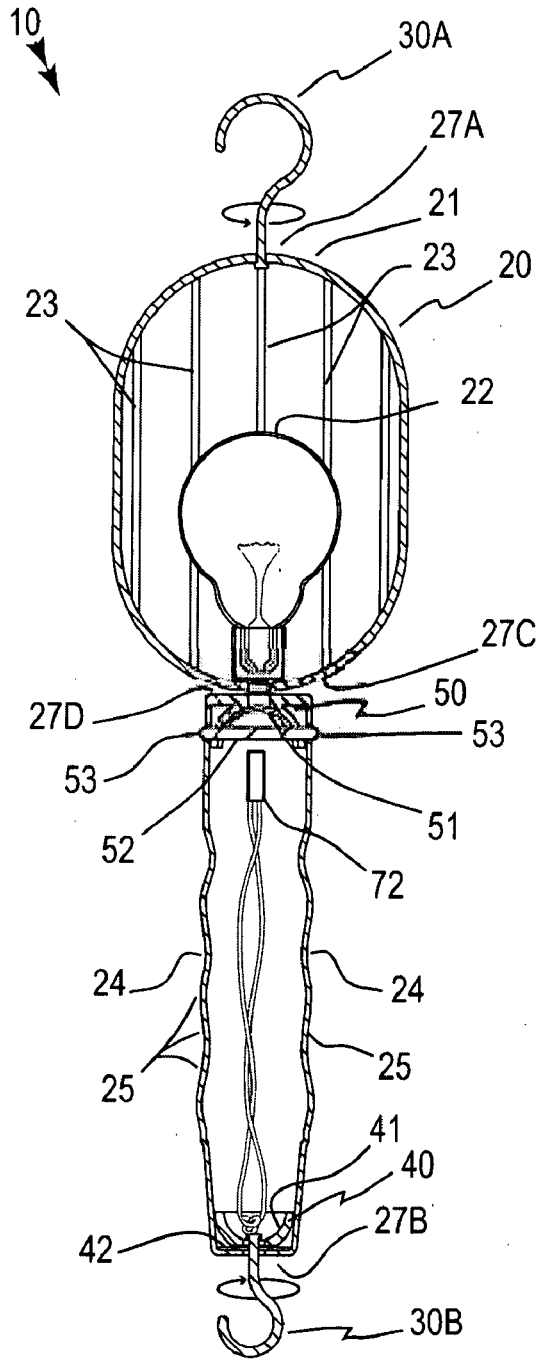
FIG. 4 is a cross-sectional view of the device shown in FIG. 3, taken along line 4-4, and showing the handle rotating and second hook rotating mechanisms.

Referring to FIG. 4, a mechanism 40 is included for freely rotating the second hook 30B about the bottom end 27B of the handle 24. Such a second hook rotating mechanism 40 includes a first semi-spherical hollow ball-bearing 41 that is disposed at the bottom end 27B of the handle 24 and is rotatably seated within the axial bore 26. A first flat washer 42 is nested within the axial bore 26 and is directly anchored, without the use of intervening elements, on the bottom end 27B of the handle 24. Such a first washer 42 has a flat top surface 43 for effectively supporting the first ball-bearing 41 thereon.

Still referring to FIG. 4, a mechanism 50 is included for freely rotating the handle 24 about a bottom end 27C of the light-emitting assembly 20, which is crucial for preventing the secondary power cord 60B (described herein below) from becoming entangled as the user manipulates a peripheral device 12 attached to the device 10 about their work space. Such a handle rotating mechanism 50 includes a second semi-spherical hollow ball-bearing 51 disposed at a top end 27D of the handle 24 and rotatably seated within the axial bore 26. The second ball-bearing 51 is oppositely situated from the first ball-bearing 41 and further remains statically registered within the axial bore 26 when the first ball-bearing 41 is freely rotated within the axial bore 26. A quick-release pin 52 is directly anchored, without the use of intervening elements, to the top end 27D of the handle 24. Such a pin 52 passes through the second ball-bearing 51 and has opposed outer ends 53 protruding to an exterior of the handle 24. The handle 24 effectively maintains a static relationship with the second ball-bearing 51 when the pin 52 is passed through the handle 24, thus conveniently allowing a user to quickly and easily adapt the handle between rotating and non-rotating states.

Referring to FIGS. 1, 2, 3, 5 and 6, primary 60A and secondary 60B power cords are coupled to the handle 24. Such a secondary power cord 60B includes a transparent cap 61 that is directly mated, without the use of intervening elements, to a distal end 62 thereof. At least one LED 63 is housed within the cap 61 and is electrically coupled to the second switch 74 (described herein below). Such an LED 63 conveniently illuminates when the second current 71B (described herein below) is passing through the secondary power cord 60B, which is crucial for advantageously and effectively notifying a user that the second power cord 60B is hot. The secondary power cord 60B conveniently allows a user to attach a variety of peripheral devices 12 thereto, especially peripheral devices 12 that are provided with a short power cord of their own.

Figure 5:
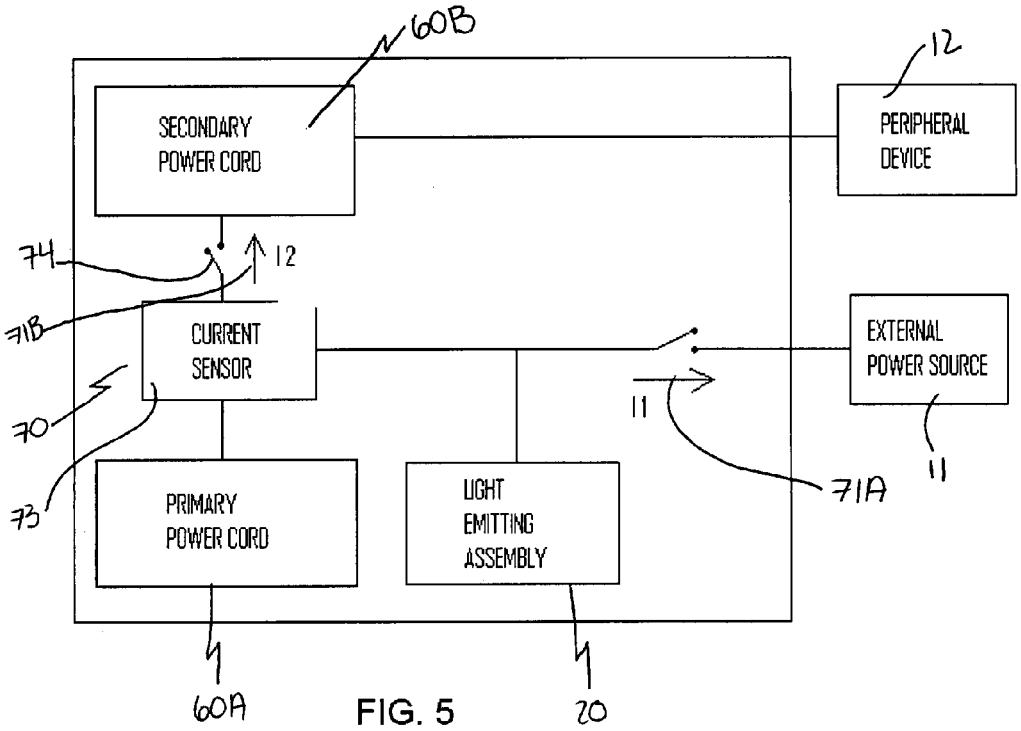
FIG. 5 is a schematic block diagram of the device shown in FIGS. 1-4.
Figure 6:
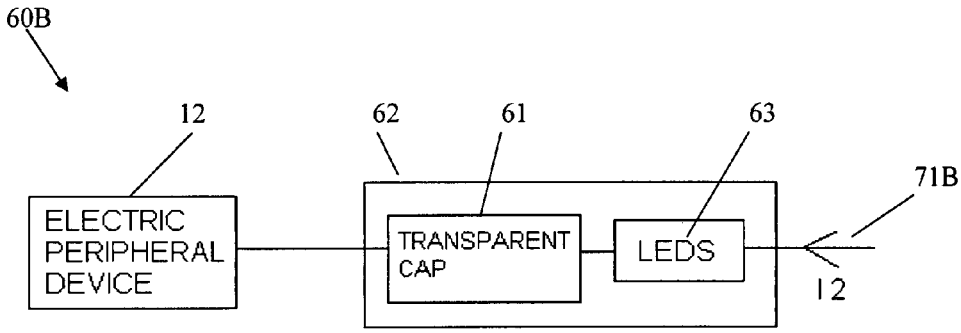
FIG. 6 is a schematic block diagram of the schematic block diagram of the secondary power cord shown in FIG. 5.

Referring to FIG. 5, a mechanism 70 is included for automatically and simultaneously distributing first 71A and second 71B currents to the primary 60A and secondary 60B power cords respectively during operating conditions such that the second current 71B is effectively transmitted to the secondary power 60B cord if and only if the first current 71A is passing through the primary power cord 60A. Such an automatic and simultaneous current distributing mechanism 70 includes a first switch 72 that is electrically coupled to an exterior power supply source 11.

A current sensor 73 is electrically coupled to the first switch 72 and located downstream thereof. Such a current sensor 73 is electrically coupled directly, without the use of intervening elements, to the primary power cord 60A. A second switch 74 is electrically coupled directly, without the use of intervening elements, to the current sensor 73 and is located downstream thereof. Such a second switch 74 is electrically coupled to the secondary power cord 60B. Suitable current sensors 73 may be purchased from Furison Electric, Inc. (www.furisonelectric.com). For example, part numbers FCS004 through FCS011 provide suitable current sensors 73 that effectively perform the intended function of detecting when a first current 71A is passing to the primary power cord 60A. Such current sensors 73 advantageously provide a digital controller for more accurately detecting amperage in the present invention.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined work light and dual power cord device comprising:

a light-emitting assembly including a protective cage having an access door pivotally adaptable between open and closed positions;

an elongated handle rotatably conjoined directly to said light emitting assembly, said handle having an axial bore formed therein, said axial bore extending along an entire longitudinal length of said handle;

a first hook directly connected to a top end of said light-emitting assembly and being spaced from said handle;

a second hook directly connected to a bottom end of said handle and being spaced from said light-emitting assembly;

means for freely rotating said handle about a bottom end of said light-emitting assembly;

means for freely rotating said second hook about said bottom end of said handle;

primary and secondary power cords coupled to said handle; and means for automatically and simultaneously distributing first and second currents to said primary and secondary power cords respectively during operating conditions such that said second current is transmitted to said secondary power cord if and only if said first current is passing through said primary power cord.

2. The device of claim 1, wherein said second hook rotating means comprises:

a first semi-spherical hollow ball-bearing disposed at said bottom end of said handle and rotatably seated within said axial bore; and a first flat washer nested within said axial boreand directly anchored on said bottom end of said handle, said first washer having a flat top surface supporting said first ball-bearing thereon.

3. The device of claim 1, wherein said handle rotating means comprises:

a second semi-spherical hollow ball-bearing disposed at a top end of said handle and rotatably seated within said axial bore, said second ball-bearing being oppositely situated from said first ball-bearing and further remaining statically registered within said axial bore when said first ball-bearing is freely rotated within said axial bore; and a quick-release pin directly anchored to said top end of said handle, said pin passing through said second ball-bearing and having opposed outer ends protruding exterior of said handle, wherein said handle maintains a static relationship with said second ball-bearing when said pin is passed through said handle.

4. The device of claim 1, wherein said automatic and simultaneous current distributing means comprises:

a first switch electrically coupled to an exterior power supply source;

a current sensor electrically coupled to said first switch and located downstream thereof, said current sensor being electrically coupled directly to said primary power cord; and a second switch electrically coupled directly to said current sensor and being located downstream thereof, said second switch being electrically coupled to said secondary power cord.

5. The device of claim 1, wherein said secondary power cord comprises:

a transparent cap directly mated to a distal end thereof; and at least one LED housed within said cap and electrically coupled to said second switch;

wherein said LED illuminates when said second current is passing through said secondary power cord for notifying a user that said second power cord is hot.

6. A combined work light and dual power cord device comprising:

a light-emitting assembly including a protective cage having an access door pivotally adaptable between open and closed positions;

an elongated handle rotatably conjoined directly to said light emitting assembly, said handle having an axial bore formed therein, said axial bore extending along an entire longitudinal length of said handle, wherein said handle is permanently attached to said light-emitting assembly;

a first hook directly connected to a top end of said light-emitting assembly and being spaced from said handle;

a second hook directly connected to a bottom end of said handle and being spaced from said light-emitting assembly;

means for freely rotating said handle about a bottom end of said light-emitting assembly;

means for freely rotating said second hook about said bottom end of said handle;

primary and secondary power cords coupled to said handle; and means for automatically and simultaneously distributing first and second currents to said primary and secondary power cords respectively during operating conditions such that said second current is transmitted to said secondary power cord if and only if said first current is passing through said primary power cord.

7. The device of claim 6, wherein said second hook rotating means comprises:

a first semi-spherical hollow ball-bearing disposed at said bottom end of said handle and rotatably seated within said axial bore; and a first flat washer nested within said axial boreand directly anchored on said bottom end of said handle, said first washer having a flat top surface supporting said first ball-bearing thereon.

8. The device of claim 6, wherein said handle rotating means comprises:

a second semi-spherical hollow ball-bearing disposed at a top end of said handle and rotatably seated within said axial bore, said second ball-bearing being oppositely situated from said first ball-bearing and further remaining statically registered within said axial borewhen said first ball-bearing is freely rotated within said axial bore; and a quick-release pin directly anchored to said top end of said handle, said pin passing through said second ball-bearing and having opposed outer ends protruding exterior of said handle, wherein said handle maintains a static relationship with said second ball-bearing when said pin is passed through said handle.

9. The device of claim 6, wherein said automatic and simultaneous current distributing means comprises:

a first switch electrically coupled to an exterior power supply source;

a current sensor electrically coupled to said first switch and located downstream thereof, said current sensor being electrically coupled directly to said primary power cord; and a second switch electrically coupled directly to said current sensor and being located downstream thereof, said second switch being electrically coupled to said secondary power cord.

10. The device of claim 6, wherein said secondary power cord comprises:

a transparent cap directly mated to a distal end thereof; and at least one LED housed within said cap and electrically coupled to said second switch;

wherein said LED illuminates when said second current is passing through said secondary power cord for notifying a user that said second power cord is hot.

11. A combined work light and dual power cord device comprising:

a light-emitting assembly including a protective cage having an access door pivotally adaptable between open and closed positions;

an elongated handle rotatably conjoined directly to said light emitting assembly, wherein said handle has a corrugated outer surface for providing an increased gripping surface area, said handle having an axial bore formed therein, said axial bore extending along an entire longitudinal length of said handle, wherein said handle is permanently attached to said light-emitting assembly;

a first hook directly connected to a top end of said light-emitting assembly and being spaced from said handle;

a second hook directly connected to a bottom end of said handle and being spaced from said light-emitting assembly;

means for freely rotating said handle about a bottom end of said light-emitting assembly;

means for freely rotating said second hook about said bottom end of said handle;

primary and secondary power cords coupled to said handle; and means for automatically and simultaneously distributing first and second currents to said primary and secondary power cords respectively during operating conditions such that said second current is transmitted to said secondary power cord if and only if said first current is passing through said primary power cord.

12. The device of claim 11, wherein said second hook rotating means comprises:

a first semi-spherical hollow ball-bearing disposed at said bottom end of said handle and rotatably seated within said axial bore; and a first flat washer nested within said axial bore and directly anchored on said bottom end of said handle, said first washer having a flat top surface supporting said first ball-bearing thereon.

13. The device of claim 11, wherein said handle rotating means comprises:

a second semi-spherical hollow ball-bearing disposed at a top end of said handle and rotatably seated within said axial bore, said second ball-bearing being oppositely situated from said first ball-bearing and further remaining statically registered within said axial borewhen said first ball-bearing is freely rotated within said axial bore; and a quick-release pin directly anchored to said top end of said handle, said pin passing through said second ball-bearing and having opposed outer ends protruding exterior of said handle, wherein said handle maintains a static relationship with said second ball-bearing when said pin is passed through said handle.

14. The device of claim 11, wherein said automatic and simultaneous current distributing means comprises:

a first switch electrically coupled to an exterior power supply source;

a current sensor electrically coupled to said first switch and located downstream thereof, said current sensor being electrically coupled directly to said primary power cord; and a second switch electrically coupled directly to said current sensor and being located downstream thereof, said second switch being electrically coupled to said secondary power cord.

15. The device of claim 11, wherein said secondary power cord comprises:

a transparent cap directly mated to a distal end thereof; and at least one LED housed within said cap and electrically coupled to said second switch;

wherein said LED illuminates when said second current is passing through said secondary power cord for notifying a user that said second power cord is hot.

* * * * *